US006138621A

United States Patent [19]

Albanello et al.

[11] Patent Number: 6,138,621

[45] Date of Patent: Oct. 31, 2000

[54] INTERNAL COMBUSTION ENGINE WITH VARIABLE VALVE ACTUATION

[75] Inventors: Stefano Albanello; Lorentino Macor; Rosario Nasto, all of Orbassano, Italy

[73] Assignee: C.R.F. Societa Consortile per Azioni, Italy

[21] Appl. No.: 09/257,370

[22] Filed: Feb. 25, 1999

[30] Foreign Application Priority Data

Feb. 26, 1998 [IT] Italy ..... T098A0156

[51] Int. Cl.[7] ..... F01L 9/02; F01L 13/00

[52] U.S. Cl. ..... 123/90.12; 123/90.16; 123/90.19; 123/90.49

[58] Field of Search ..... 123/90.12, 90.13, 123/90.15, 90.16, 90.19, 90.35, 90.48, 90.49, 90.55, 90.57

[56] References Cited

U.S. PATENT DOCUMENTS

| | | | |
|---|---|---|---|
| 4,889,085 | 12/1989 | Yagi et al. | 123/90.12 |
| 5,158,048 | 10/1992 | Robnett et al. | 123/90.16 |
| 5,216,988 | 6/1993 | Taxon | 123/90.12 |
| 5,275,136 | 1/1994 | Schechter et al. | 123/90.12 |
| 5,421,359 | 6/1995 | Meister et al. | 137/12 |
| 5,485,813 | 1/1996 | Molitor et al. | 123/90.12 |
| 5,531,192 | 7/1996 | Feucht et al. | 123/90.12 |
| 5,577,468 | 11/1996 | Weber | 123/90.12 |

FOREIGN PATENT DOCUMENTS 803642 10/1997 European Pat. Off. .

*Primary Examiner*—Weilun Lo
*Attorney, Agent, or Firm*—Sughrue, Mion, Zinn, Macpeak & Seas, PLLC

[57] ABSTRACT

An internal combustion engine having a hydraulic system for valve variable actuation and a hydraulic braking device for braking the valve in the final stage of its closing travel. A passage is provided for excluding the above mentioned braking when the engine is in operative conditions in which the fluid used in the device has a viscosity greater than a predetermined value.

4 Claims, 3 Drawing Sheets

INTERNAL COMBUSTION ENGINE WITH VARIABLE VALVE ACTUATION

BACKGROUND OF THE INVENTION

The present invention relates to internal combustion engines of the type comprising:

at least one intake valve and at least one exhaust valve for each cylinder, each provided with respective spring means for biassing the valve to a closed position, for controlling communication between respective intake and exhaust conduits and a combustion chamber, a camshaft for actuating the intake and exhaust valves of the engine cylinders by means of respective tappets, each intake valve and each exhaust valve being driven by a cam of said camshaft, wherein at least one of said tappets drives the respective intake or exhaust valve, against the action of said biassing spring means, with the interposition of hydraulic means including a chamber of fluid under pressure, said chamber of fluid under pressure being adapted to be connected through a solenoid valve to an outlet channel, in order to uncouple the valve from the respective tappet so as to cause quick closing of the valve, under the action of the respective biassing spring means, said hydraulic means further comprising a piston associated with the stem of the valve and slidably mounted within a guiding cylinder, said piston facing a variable volume chamber defined by said piston within said guiding cylinder, said variable volume chamber being in communication with the chamber of fluid under pressure through a connecting aperture formed in one end of said guiding cylinder, said piston having an end nose adapted to be introduced within said connecting aperture during the final portion of the piston travel when the valve is closed, in order to reduce the communication port between said variable volume chamber and said chamber of fluid under pressure, so as to brake the valve travel in proximity of its closed position.

An engine of the above indicated type is disclosed for example in European Patent application EP-A-0 803 642 of the same applicant.

The above described system provides a variable control of the opening of the intake and/or exhaust valves without altering the mechanical parts which control the valve displacement. In fact, whilst in a conventional valve driving system the movement of each intake or exhaust valve is only due to the geometry of the mechanical parts which drive the valve (cam, tappet, and rocker arm, if any), in the above described known system, the solenoid valve controlling the pressure chamber associated with a given valve can be driven open at any time this is desired (typically it is controlled by electronic control means depending upon one or more parameters of operation of the engine), so as to empty the above mentioned chamber of fluid under pressure (which usually is the lubricating oil of the engine) thus causing the quick closing of the intake or exhaust valve, under the action of the respective biassing spring means, even during a stage in which the respective cam would keep the valve open.

As already indicated above, the known solution provides for a piston associated with the valve which is slidably mounted within a guiding cylinder. The piston faces a chamber of variable volume defined thereby within the guiding cylinder and communicating with the chamber of fluid under pressure by means of a connecting aperture formed at one end of the guiding cylinder. In order to slow down the travel of the valve in proximity of its closed position, so as to avoid damages due to an impact at an excessive speed of the valve against its seat when the pressure chamber is emptied so as to uncouple the valve from the respective tappet, the above mentioned piston has an end nose adapted to be introduced within said connecting aperture during the final portion of the travel of the piston when the valve is closed, in order to reduce the communication port between the variable volume chamber and the chamber of fluid under pressure, thus braking the travel of the valve in proximity of its closed position.

Studies and tests conducted by the applicant have shown however that the braking effect thus obtained can become excessive if the fluid under pressure (typically the lubricating oil of the engine) has a high viscosity due to a low value of its temperature. Thus, for example, when the ambient temperature is low, for example in the order of −10° C., and the engine has not reached a normal operating condition subsequent to a cold start, the viscosity of the oil may be such that the valve closing time becomes excessive. For example a lubricating oil which in normal operating conditions may have a kinematic viscosity in the order to 15 centistokes, may have a viscosity of up to 4000 centistokes at a temperature of −20° C.

SUMMARY OF THE INVENTION

In order to overcome this drawback, the invention provides an engine of the type indicated at the beginning of the present description, characterized in that it comprises means for providing an additional communication between said variable volume chamber and said chamber of fluid under pressure, so as to eliminate or reduce the braking effect at the end of the closing travel of the valve.

The above mentioned means may be controlled as a function of the temperature of the fluid under pressure, or as a function of the ambient temperature, to avoid an excessive closing time of the valve due to the increase of the viscosity of the oil within the actuating system.

In a preferred embodiment, the above mentioned means for providing the additional communication between the variable volume chamber and the chamber of fluid under pressure comprises a rotating valve element, which can be moved between a first position in which it provides said additional communication and a second position in which this communication is interrupted. The above mentioned valve element is rotatably mounted within a cavity where two conduits open which are communicated to the variable volume chamber and the chamber of fluid under pressure, respectively, this valve element defining a passage adapted to come into communication with both said conduits when the valve element is in its first position. For instance, this passage is defined by a longitudinal slot formed on the outer surface of the valve element and the two above mentioned conduits open at two spaced areas, which are longitudinally aligned, of the surface of the cylindrical cavity in which the valve element is rotatably mounted.

The rotation of the valve element may be controlled by motor means which are controlled by the above mentioned electronic control means associated with the valve actuation system, as a function of the operating conditions of the engine.

Due to the above mentioned features, the valves can be driven in any operating condition of the engine at a speed which on one hand provides for the quick closing of the valve and on the other hand avoids damages due to a two strong impact of the valve against its seat when the valve is closed. This result is obtained, as clearly apparent, with relatively simple and inexpensive means.

BRIEF DESCRIPTION OF THE DRAWINGS

Further features and advantages of the invention will become apparent from the description which follows with reference to the annexed drawings, given purely by way of non limiting example, in which.

DETAILED DESCRIPTION OF THE INVENTION

Figure 1:
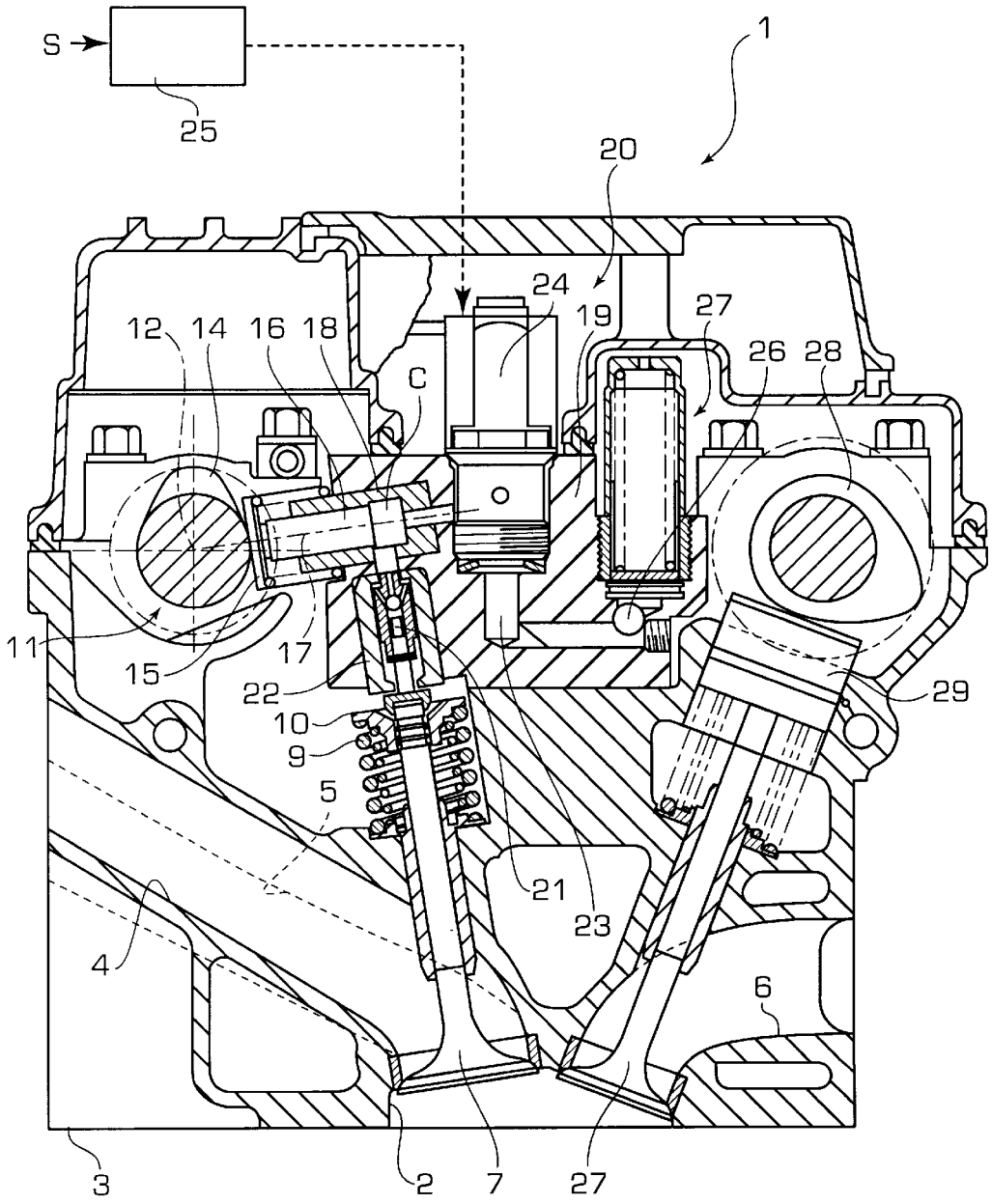
FIG. 1 is a cross-sectional view of a head of an internal combustion engine according to the embodiment known from European Patent application EP-A-0 803 642 of the same applicant.

With reference to FIG. 1, the internal combustion engine described in previous European Patent application EP-A-0 803 642 of the same applicant is a multi-cylinder engine, such as an engine with five cylinders in line, comprising a cylinder head 1. The head 1 comprises, for each cylinder, a cavity 2 formed in the bottom surface 3 of the head 1, defining the combustion chamber, in which two intake conduits 4, 5 and two exhaust conduits 6 open. The communication of the two intake conduits 4, 5 with combustion chamber 2 is controlled by two intake valves 7, of the conventional mushroom type, each comprising a stem 8 slidably mounted within the body of head 1. Each valve 7 is biassed towards its closed position by springs 9 interposed between an inner surface of head 1 and an end cap 10 of the valve. The opening of the intake valves 7 is controlled, in the way which will be described in the following, by a camshaft 11 rotatably mounted around an axis 12 within supports of the head 1 and comprising a plurality of cams 14 for actuating the valve.

Each cam 14 controlling an intake valve 7 cooperates with a plate 15 of a tappet 16 slidably mounted along an axis 17 substantially directed at 90 degrees relative to the axis of valve 7, within a bush 18 carried by a body 19 of a preassembled sub-unit 20 incorporating all the electric and hydraulic devices associated with the actuation of the intake valves, as described in detail in the following. The tappet 16 is able to apply a force to stem 8 of the valve 7, so as to cause opening of the latter against the action of spring means 9, by means of fluid under pressure (typically oil coming from the lubricating circuit of the engine) present in a chamber C and a piston 21 slidably mounted within a cylindrical body constituted by a bush 22 which is also carried by the body 19 of the sub-unit 20. Also the known solution shown in FIG. 1, the chamber C of fluid under pressure associated with each intake valve 7 can be put in communication with an outlet channel 23 by means of a solenoid valve 24. The solenoid valve 24, which may be of any known type, adapted to the function illustrated herein, is controlled by electronic control means, diagrammatically designated by 25, as a function of the signals S indicative of operating parameters of the engine, such as the position of the accelerator and the rotational speed of the engine. When the solenoid valve 24 is opened, the chamber C comes in communication with the channel 23, so that fluid under pressure present in chamber C flows through this channel and the tappet 16 is uncoupled from the respective intake valve 7, which thus rapidly returns to its closed position, under the action of return springs 9. By checking the communication between chamber C and the outlet channel 23, is thus possible to vary the timing and the travel for opening each intake valve 7, at will.

The outlet channels 23 of the various solenoid valves 24 all open on a same longitudinal channel 26 communicating with two pressure accumulator 27, only one of which is shown in FIG. 1. All the tappets 16 with the associated bushes 18, the pistons 21 with the associated bushes 22, the solenoid valves 24 and the associated channels 23, 26 are carried and formed within the same body 19 of the pre-assembled sub-unit 20, to the advantage of rapidity and easiness of assembling of the engine.

The exhaust valve 27 associated with each cylinder are controlled, in the embodiment shown in FIG. 1, in a conventional way by a camshaft 28 through respective tappets 29.

Figure 2:
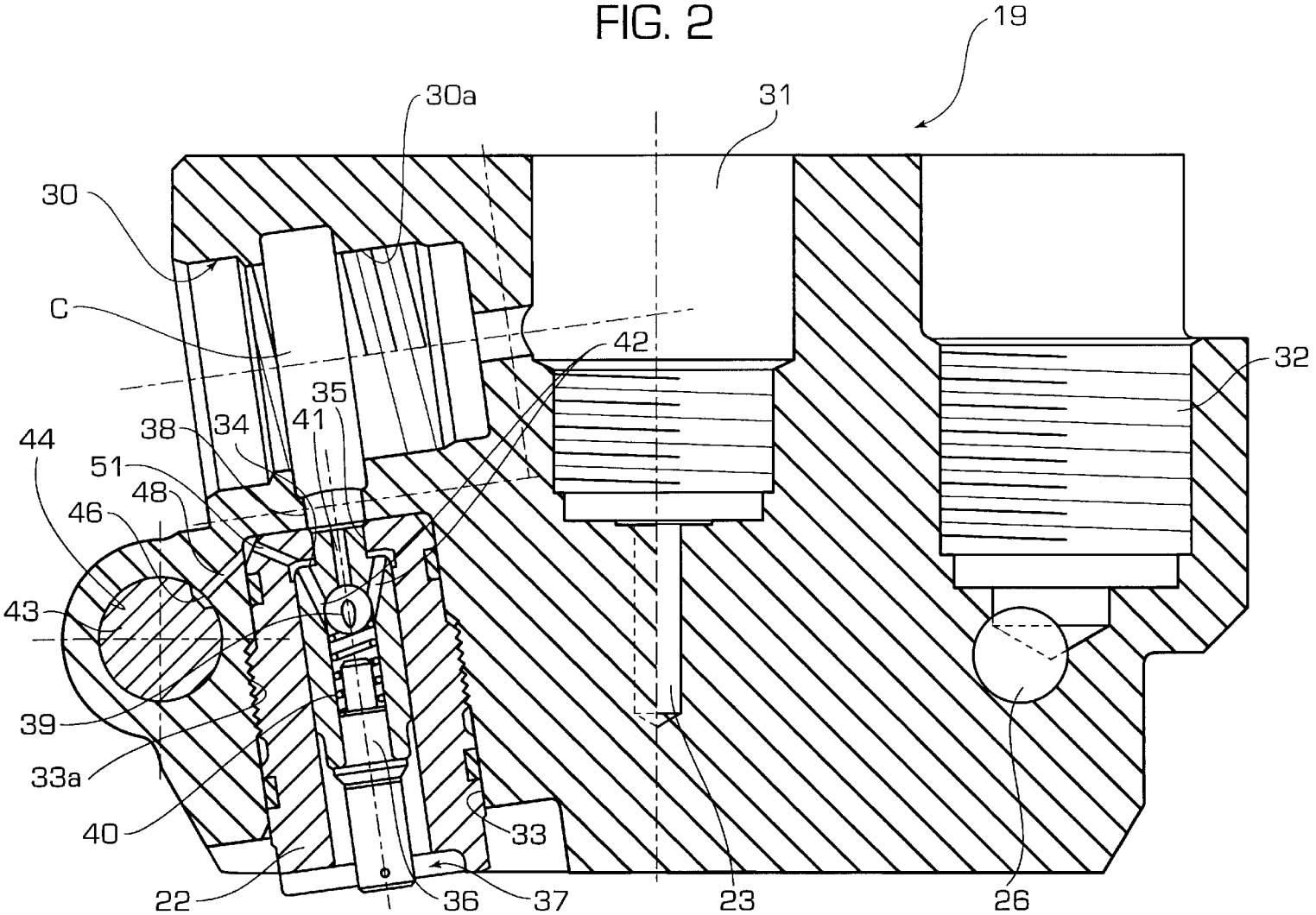
FIGS. 2, 3 are cross-sectional views at an enlarged scale of a detail of FIG. 1, modified according to the present invention.
Figure 3:
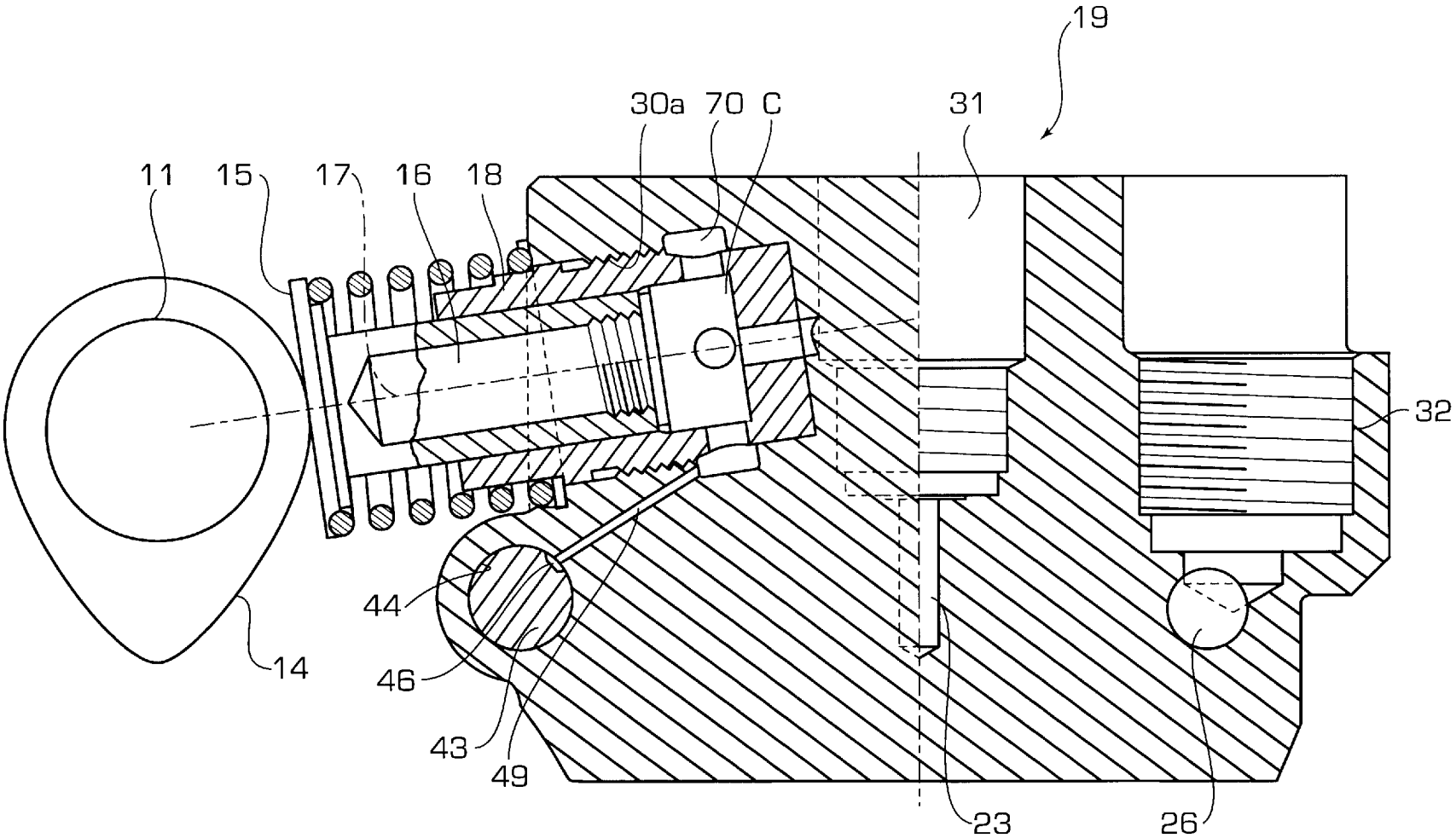

FIGS. 2, 3 show at an enlarged scale the body 19 of the pre-assembled sub-unit 20 modified according to the present invention and in two different planes. FIGS. 2, 3 relate to a case in which each cam 14 simultaneously controls a pair of intake valves. Therefore, whilst in the case of FIG. 1 the axis 17 of the tappet is co-planar with the axis of valve 7, in the case of FIGS. 2, 3 the axis 17 is in an intermediate plane between the axes of the two valves.

In FIG. 2, for sake of simplicity, only the body 19 has been illustrated, with the seat 30 for the bush 18, the seat 31 for the solenoid valve 24 and the seat 32 for the accumulator 27, with the parts inserted within said seats being not shown, so as to render the drawing simpler. FIG. 2 shows also the seat 33 which receives the bush 22. However, in this case also the parts arranged within seat 33 have been shown, since they are relevant for understanding the present invention. A first difference of construction of the engine according to the invention with respect to that of the prior art shown in FIG. 1 lies in that all the above mentioned seats are constituted by cylindrical holes having threaded portions for receiving screweable parts which are mounted therein. In particular, the seat 30 has a threaded cylindrical portion 30*a* for screwing the bush 18 (see FIG. 3) whilst the seat 33 has a threaded portion 33*a* for screwing the bush 22. The threaded coupling is safer with respect to a simple fitting coupling which is provided for bushes 18 and 22 in the known device.

FIG. 2 shows the structure of piston 21 in detail. Piston 21, in a way known per se, has a tubular body slidably mounted within bush 22 and defining a variable volume chamber 34 within this bush which communicates with the chamber C of fluid under pressure by means of a central end aperture 35 formed in bush 22. The opposite end of piston 21 is fitted over an end portion 36 of a stem 37 associated with the stem 8 of the valve 7 (FIG. 1). During normal operation, when the cam 14 drives the aperture of valve 7, it causes displacement of tappet 16 by causing a transfer of fluid under pressure from chamber C to chamber 34 and the resulting aperture of valve 7 against the action of spring 9. Chamber C communicates with an annular chamber 70 by means of radial holes 71 formed in bush 18. The annular chamber 70 communicates with the cylinders associated with the two valves 7. According to the prior art, the quick closing of the valve can be obtained by emptying chamber C of oil under pressure through the opening of solenoid valve 24. In this case, valve 7 returns rapidly to its closed position under the action of springs 9. In order to avoid a too strong impact of the valve 7 against its seat, in proximity of reaching its closed position, the valve 7 is slowed down. This result is obtained, also according to the prior art, with braking hydraulic means, constituted by a central end nose 38 provided on the piston 21 and adapted to be introduced into aperture 35 of bush 22 during the final portion of the closing travel of the valve. During the closing travel, the piston 21 moves upwardly (with reference to FIG. 2) and the variable volume chamber 34 decreases in volume, so that oil under pressure is pushed towards chamber C. When the end nose 38 of piston 21 enters into aperture 35, the oil under pressure returns from chamber 34 to chamber C through the small play (not shown in the drawings) between the nose 38 and the wall of aperture 35. The oil flow is thus substantially slowed down, so that the valve travel is also slowed down. Also according to the prior art, with the cylinder 21 there is associated a one-way valve comprising a ball shutter 39 pushed within the tubular body of piston 21 by a spring 40 towards a position obstructing a central end hole 41 of the piston 21, which extends from the inner cavity of piston 21 and opens on the end facing chamber C. The inner chamber of piston 21 also communicates with side passages 42 which open on the annular end surface of piston 21 which surrounds nose 38 and faces chamber 34. As already indicated, the above described structure is also known. The function of the shutter 39 is the following. During the closing travel of the valve 7, the shutter 39 is kept in its closed position by the spring 40 and the operation of the device is that already described above. When the chamber C is emptied of the oil under pressure by opening the solenoid valve 20, the valve 7 quickly returns to its closed position under the action of springs 9, and is slowed down immediately before it is completely closed, due to the engagement of nose 38 into aperture 35, so as to avoid a strong impact of the valve against its seat. When the valve is instead opened, in order that the pressure applied by cam 14 through tappet 16 to piston 21 is transmitted rapidly, the shutter 39 is moved to the opened position, against the action of spring 40, due to the force applied by the fluid under pressure coming from chamber C. The opening of shutter 39 makes the pressure to be communicated through hole 41 and the side holes 42 directly to the end annular surface of the piston 21 which faces the chamber 34, so that a high force can be applied to piston 21 even when the nose 38 is still within aperture 35.

As already indicated at the beginning of the present description, in the known solution described above, there is the problem that the closing time of the valve 7 may become too long, because of the intervention of the above described hydraulic braking means (aperture 35 and nose 38) when the lubricating oil has a very high viscosity, such as in the case of a cold start of the engine with a very low ambient temperature.

In order to overcome this drawback, the invention provides means adapted to exclude the above mentioned hydraulic braking means. In the embodiment illustrated herein, these means for excluding the braking means comprises a rotating valve element 43 rotatably mounted within a cylindrical cavity 44 of body 19. The rotating valve element 43 has a longitudinal slot on its outer surface defining an axial conduit 46, adapted to come into communication with two channels 48, 49, respectively, which are formed in body 19 and are communicated one to the variable volume chamber 34 (through a channel 51) and the other one to the pressure chamber C, through the annular chamber 70 and the radial holes 71. The two channels 48, 49 open at two spaced areas, which are longitudinally aligned, of the cylindrical cavity 44. Therefore, when the rotating valve element 43 is in a first operative position in which, as shown in FIGS. 2, 3, the passage 46 communicates chambers 34 and C with each other, the braking effect due to the introduction of nose 38 into aperture 35 during the final stage of the closing of the valve is excluded, since the oil present in chamber 34 can flow directly into chamber C through channel 51, channel 48, passage 46, channel 49, chamber 70 and holes 71.

When the valve element 43 is rotated from this operative position, the above mentioned additional communication is interrupted.

The valve element 43 can be rotated by motor means of any known type (not shown) which can be driven by electronic control means 25. The valve elements can be controlled as a function of the operative conditions of the engine, such as, depending upon the temperature of the lubricating oil and/or the ambient temperature, so as to exclude the hydraulic brake when the oil has a viscosity so high as to render the valve closing time too long.

Naturally, while the principle of the invention remains the same, the details of construction and the embodiments may widely vary with respect to what has been described and illustrated purely by way of example.

It is clearly apparent that, for instance, the structure of the means adapted to exclude the hydraulic brake may be different from that described above. Therefore, it would be possible to provide any valve arrangement, for instance a slidable valve element, rather than a rotatable valve element, in order to interrupt or re-establish a direct communication between the variable volume chamber 34 and the exhaust 50. Also the motor means of said device, which have not been illustrated herein, can be made in any known way, for instance by using a rotating electric actuator, or a linear actuator of any type.

What is claimed is:

1. Internal combustion engine, comprising:

at least one intake valve and at least one exhaust valve for each cylinder, each provided with respective spring means biassing the valve to the closed position, for controlling the communication between the respective intake and exhaust conduits and the combustion chamber, a camshaft for actuating the intake and exhaust valves of the engine cylinders through respective tappets, each intake valve and each exhaust valve being driven by a cam of said camshaft, wherein at least one of said tappets drives the respective intake or exhaust valve, against the action of said biassing spring means, through the interposition of hydraulic means including a chamber of fluid under pressure, said chamber of fluid under pressure being adapted to be connected through a solenoid valve to an outlet channel, in order to uncouple the valve from the respective tappet and cause a quick closing of the valve, under the action of the respective biassing spring means, said hydraulic means further comprises a piston associated with the stem of the valve and slidably mounted within a guiding cylinder, said piston facing a variable volume chamber defined thereby within said guiding cylinder, said variable volume chamber being in communication with the chamber of fluid under pressure through a connecting aperture formed at one end of said guiding cylinder, said piston having an end nose adapted to be introduced within said connecting aperture during the final portion of the travel of the piston corresponding to the closing of the valve, for reducing a communication port between said variable volume chamber and said chamber of fluid under pressure, so as to brake the travel of the valve in proximity of its closed position, wherein said engine comprises means for providing an additional communication between said variable volume chamber and said chamber of fluid under pressure, so as to eliminate or reduce the braking effect at the end of the closing travel of the valve, wherein said means for providing the above mentioned additional communication between the variable volume chamber and the chamber of fluid under pressure comprises a valve element movable between a first position in which it provides said communication and a second position in which this communication is interrupted, and wherein said valve element is rotatably mounted within a cavity where two conduits open, respectively communicated to said variable volume chamber and said chamber of fluid under pressure, said valve element defining a passage adapted to come into communication with both said conduits when the valve element is in its first position, and said valve element being rotatable about an axis offset and orthogonal with respect to an axis of said piston.

2. Internal combustion engine according to claim 1, wherein said means for providing said additional communication between the variable volume chamber and the chamber of fluid under pressure are controlled by electronic control means, as a function of the operative conditions of the engine.

3. Internal combustion engine according to claim 2, wherein said electronic control means are able to provide said communication between the variable volume chamber and the discharge in operative conditions in which the viscosity of the fluid used in the device is greater than a predetermined threshold value.

4. Internal combustion engine according to claim 1, wherein said passage is defined by a longitudinal slot formed on the outer surface of the valve element, said conduits open at two spaced areas, which are longitudinally aligned, of the cylindrical wall of the cavity wherein the valve element is rotatably mounted.

* * * * *